US006439129B2

(12) United States Patent
Begotti

(10) Patent No.: US 6,439,129 B2
(45) Date of Patent: Aug. 27, 2002

(54) LAUNCHING SYSTEM FOR PASSENGER UNITS IN EQUIPMENTS FOR AMUSEMENT PARKS, SUCH AS ROLLER-COASTERS OR THE LIKE

(75) Inventor: Marco Begotti, Suzzara (IT)

(73) Assignee: Dario Begotti, Suzzara (IL)

( * ) Notice: Subject to any disclaimer, the term of this patent is extended or adjusted under 35 U.S.C. 154(b) by 0 days.

(21) Appl. No.: 09/814,281

(22) Filed: Mar. 21, 2001

(30) Foreign Application Priority Data

Mar. 23, 2000 (IT) ..... MI00A0610

(51) Int. Cl.[7] ..... A63G 21/10
(52) U.S. Cl. ..... 104/63; 104/55
(58) Field of Search ..... 104/53, 55, 63, 104/162

(56) References Cited

U.S. PATENT DOCUMENTS 4,165,695 A * 8/1979 Schwarzkopf ..... 104/55

* cited by examiner

*Primary Examiner*—S. Joseph Morano
*Assistant Examiner*—Lars A. Olson
(74) *Attorney, Agent, or Firm*—Notaro & Michalos P.C.

(57) ABSTRACT

The object of this invention is a launching system for cars running on a track in equipments for amusement parks, such as roller-coasters or the like, including a mechanical launching device where a falling counterweight moves a rope to pull a train of cars with the needed force, and wherein the counterweight is slowly lifted back up at the end of the launch, while the cars complete their track, thus only requiring some low-powered equipment. The system according to the invention is far cheaper to be produced than the known systems, and offers far lower operating costs.

9 Claims, 5 Drawing Sheets

SEZ.A–A

LAUNCHING SYSTEM FOR PASSENGER UNITS IN EQUIPMENTS FOR AMUSEMENT PARKS, SUCH AS ROLLER-COASTERS OR THE LIKE

FIELD AND BACKGROUND OF THE INVENTION

The invention is part of the equipment designed for amusement parks and particularly refers to amusement devices such as roller-coasters or the like, where a train of passenger units or cars is lifted to a certain height, where it completes its run under the influence of gravity.

For many years, in these plants the cars were lifted slowly along an inclined track while pulling them by a chain or the like and released in a downward section after reaching the top of the hill, so as to obtain an adequate speed to overcome the subsequent hills and drops and complete the full run.

The search for innovative solutions and the ever growing demand for new excitement on the part of the public have in recent years motivated the engineers of the field to develop new systems in which the cars are lifted along an almost vertical track and started on a very steep drop, or rides in which the cars are powerfully accelerated even in their ascent.

In a few cases, linear magnetic induction motors are used for this purpose, which however demand enormous power of the order of some megawatt, and consequently enormous costs both for the installations and their subsequent operation.

In other cases, some piston-type devices are used to lift the cars, which are also huge ones and consequently have high construction and operating costs.

This invention now enters the branch, by offering a launching system for cars on a hill and in particular along vertical track, which provides for the use, in order to adequately accelerate the cars, of a counterweighted device capable of performing the launch and later, while the cars complete their runs, is moved back to its starting position at low speed, thus requiring some little and low-powered equipments.

SUMMARY OF THE INVENTION

The object of this invention is to provide a launching system for cars running on a track as part of equipment used in amusement parks, such as roller coasters. The launching system includes a mechanical launching device where a falling counterweight moves a rope to pull a train of cars with a necessary force, wherein the counterweight is slowly lifted back up at the end of the launch, while the cars complete the track, thus only requiring some low-powered equipment. The system according to the invention is far cheaper to be produced than the known systems, and offers far lower operating costs.

The system is preferably provided with a second counterweight, having a half the mass of the main counterweight, engaged to the latter at the time of its lifting, so as to further reduce the power and therefore the size of the driving motors.

This second counterweight is then lifted again during the dropping of the main counterweight lifting the cars.

This ensures that the motor is constantly in motion, but operating at a reduced power.

BRIEF DESCRIPTION OF THE DRAWINGS

This invention will now be described in detail, for exemplifying yet non-limiting purposes, with reference to the attached figures in which:

the FIGS. 1–4 offer a simplified view of a system according to the invention, respectively in a resting, ready-to-go, launching and after-launching position;

Figure 5:
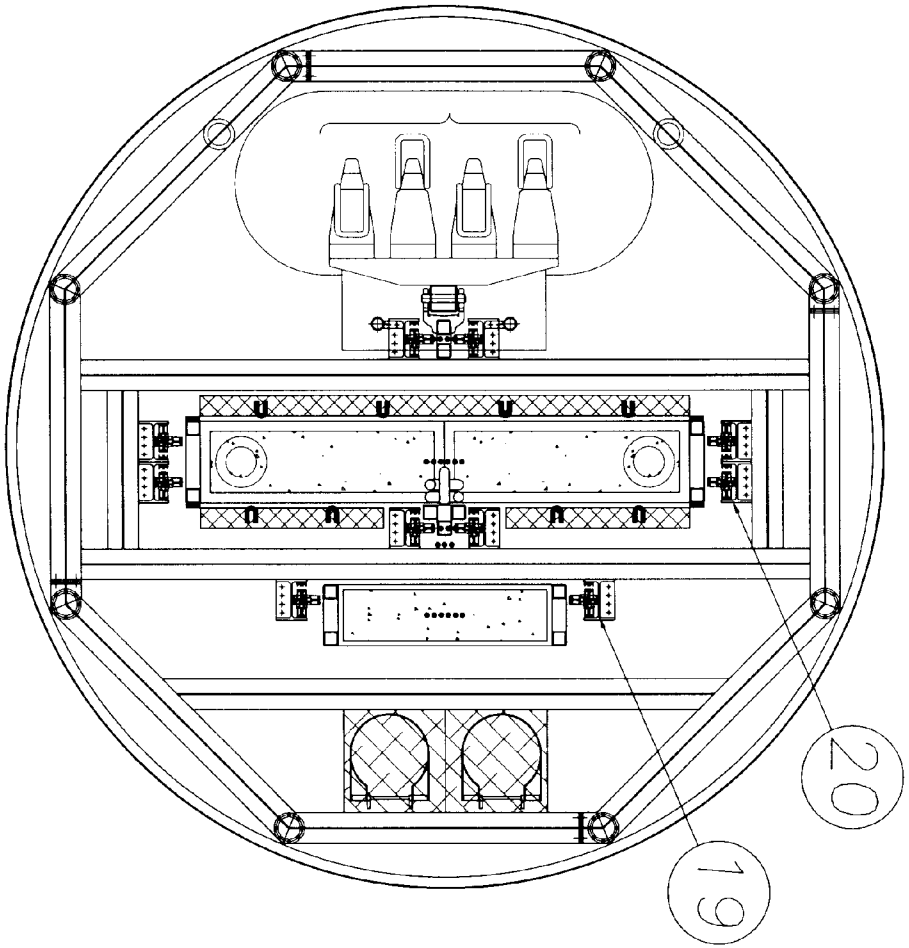

DESCRIPTION OF THE PREFERRED EMBODIMENTS the FIG. 5 offers a cross-sectional view of the car driving mechanism. With reference to the attached figures, the number 1 indicates a track along which runs a train of cars represented in its whole by 2, and a track including an essentially horizontal or slightly inclined track A, in which the cars are hooked up by the launching devices; a second and essentially vertical section B in which the cars are speeded up with a strong acceleration as required to pursue their run, and a final section C leading into the actual circuit.

The first section A of the track is marked by the presence of a hooking-up mechanism for the cars, made of a trolley 4 fitted with hooking devices 5 of a known type, which are capable of engaging the cars underneath them in order to drive them. The trolley is moved by a rope 6 actuated for instance by an electrically driven winch.

Figure 1:
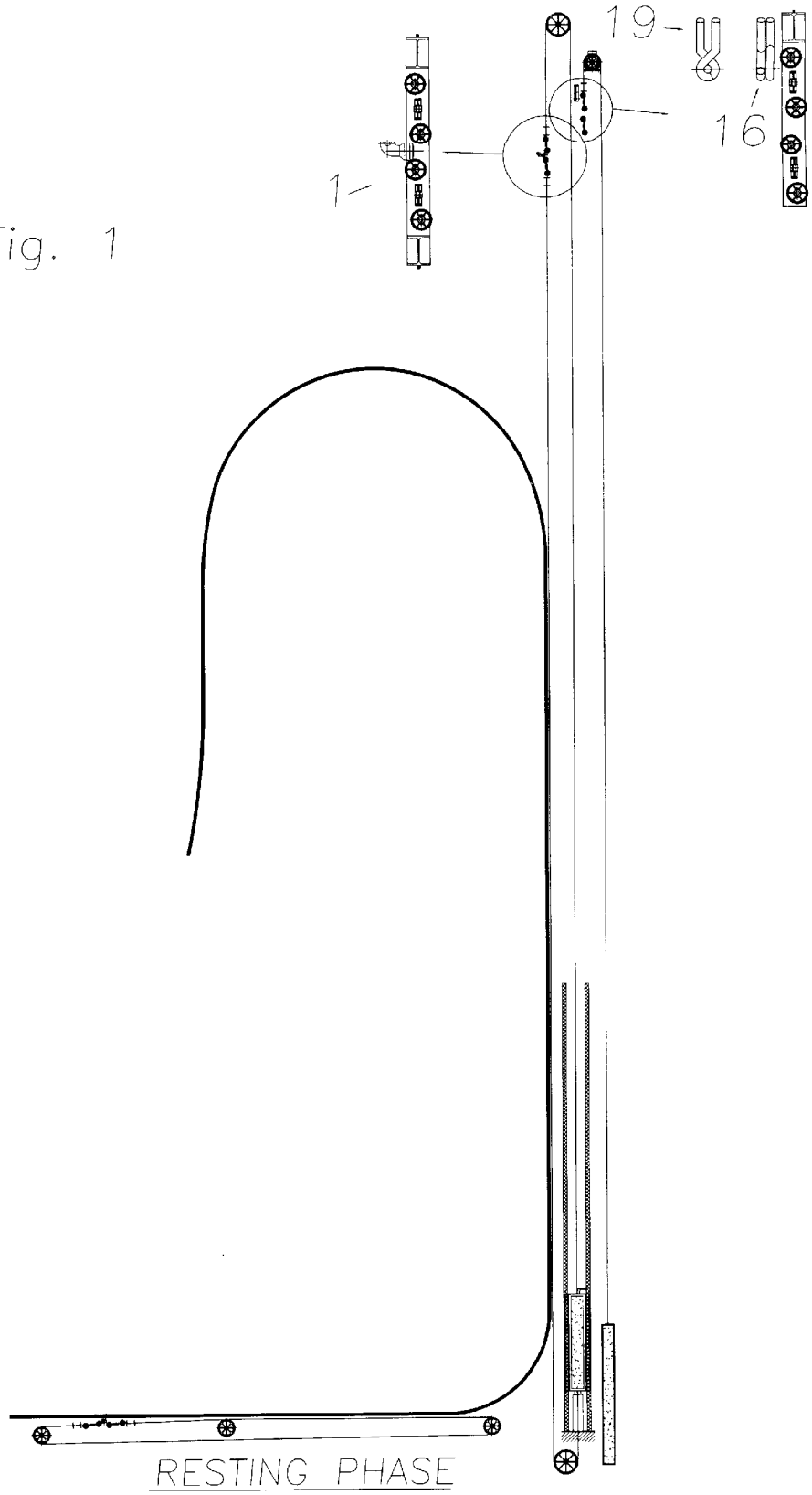

The rope is preferably arranged at a slightly inclined angle with respect to the rail accommodating the cars, so as to start the trolley from a slightly lowered position in which the hooking devices are completely below the rails; the trolley slowly goes up, while moving forward in the direction of the arrow F, until hooking onto the cars. The trolley launching devices include a trolley 7 similar to the previous one, having hooking devices as well, which is affixed to a looped rope moving vertically over a pair of pulleys 9 and 10. The rope 8 also holds a counterweight 11 with a mass superior to that constituted by the cars together with their relative passengers: in particular a counterweight whose weight is for instance thrice that of the train of cars. A braking system is provided to slow down the counterweight where the same approaches the ground at the end of its run. The system is constituted of a multiple number of permanent magnets 12 (FIG. 3) applied to the counterweight 11, and of a structure 13 formed by fins of aluminium alloy placed at its base, at the end of the track of the counterweight 11. At the end of the lower section of the counterweight's track, a provision is also made for some mechanical devices 14 and shock absorbing units 15 of a known type, capable of halting the motion of the counterweight itself. A second counterweight indicated by the number 16 is tied to a rope 17 that moves over a pulley 18 and holds, at its opposite end, some hooking-up devices 19 shown in greater detail in FIG. 1, capable of engaging the counterweight.

The mass of the secondary counterweight 16 is half that of the counterweight 11.

Both of these counterweights slide along the guides 19 and 20 illustrated in FIG. 5.

The operation is as follows.

At the end of each run, the train of cars returns to its starting position, for instance by gravity if the rail is slightly inclined, and awaits a new run. In this phase the counterweight 11 is in a totally lifted position.

The motors pulling the rope 6 are then actuated to move the trolley 4 forward in the sense of the arrow F. As the train of cars approaches, the trolley also moves upward, causing the hooking-up device 5 to project above the rails and hook up to the last car of the train.

The cars are then pushed forward, until the first car arrives at the vertical starting section, near the rope 8.

Figure 2:
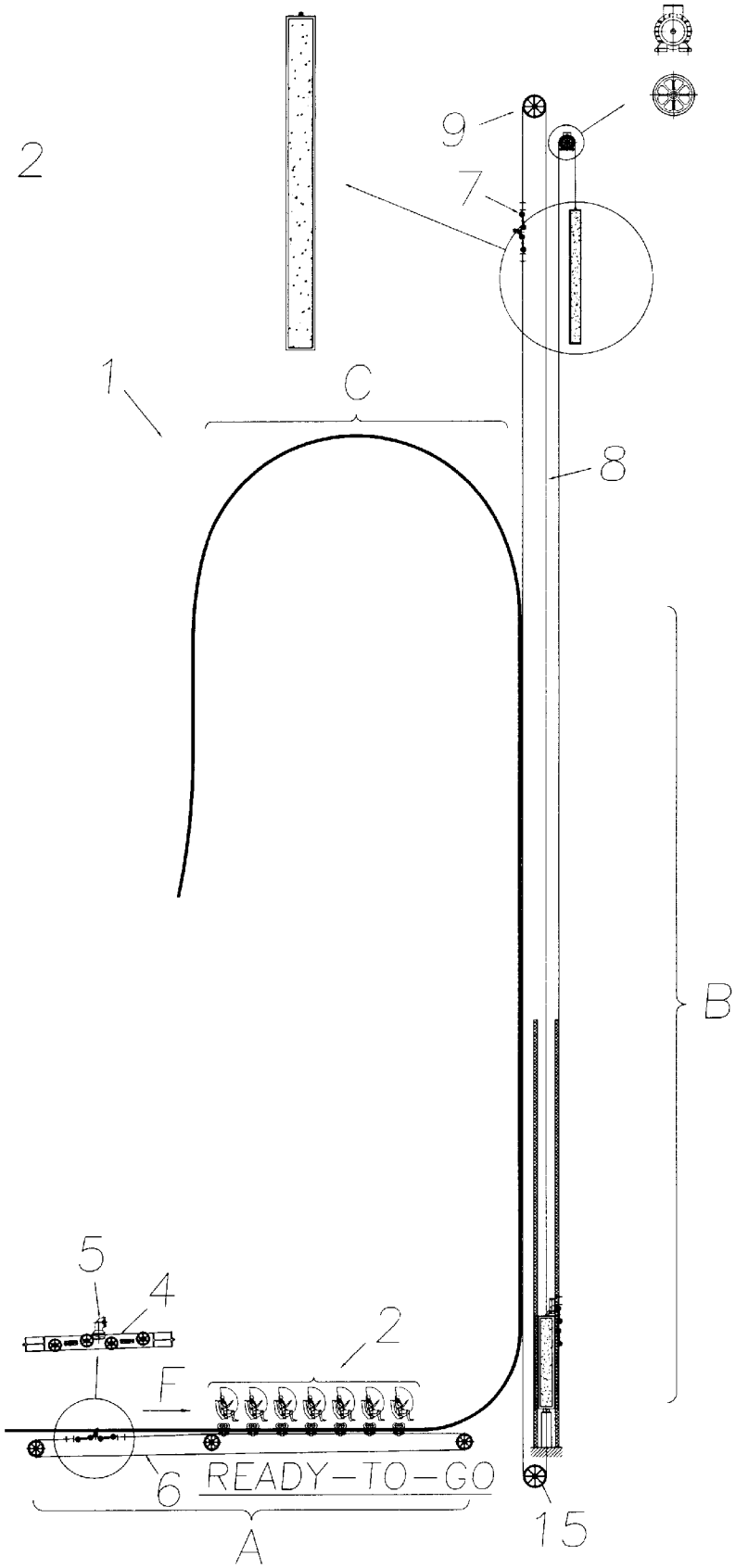

This situation or launching phase is shown in FIG. 2. While the train of cars is in this position, with one or more cars arranged in a vertical line-up near the rope 8, the counterweight 11 is released and begins to fall down.

The counterweight hauls the rope 8, which rotates over the pulleys 9 and 10 and causes the trolley 7 to hook up to one of the first cars of the train, which are thus hauled upward at a speed having a considerable acceleration.

The length of the launching section B is such that when the cars attain the end of the major hill they have already reached a speed sufficient to insert them into the final track and move them on by inertia.

For example, the counterweight can be braked when the cars are about to enter the track, so as to release the trolley due to a difference in speed, or in case of providing devices capable of unhooking the trolley from the train of cars when the latter deviate from the vertical section, to enter the track, to utilize the trolley's residual run to brake the counterweight.

The length of the rope 8 is considerably greater than that of the cars' launching track, so as to make it possible to unhook the trolley at the end of the launching phase.

An induction braking device is provided for braking the trolley, coupled with mechanical braking devices 14 and shock absorbers 15, as illustrated in FIG. 2.

While the train completes its run, there's sufficient time to lift again the counterweight 11 to return it to its originally raised starting position, ready to push on a new train of cars.

For this purpose, the free extremity of the rope 17 hooks up with the counterweight 11, to which the secondary counterweight 16 is attached, after having meantime been lifted up by the motor 18.

Because the mass of the secondary counterweight is less than that of the counterweight 11 (in this example about half), the job of lifting the latter back up will require a motor having a very lower power in comparison with the power that would be required if the counterweight 16 should be lacking.

The counterweight 16 is then lifted up again while the cars complete the track.

The system thus described makes it possible to reduce the needed power to a minimum, without sacrificing the characteristics of acceleration to be imparted to the cars, because the counterweighting system allows to provide all the necessary power in a few instants, only to restore it over a much longer period and therefore resorting to equipment and motors of a much lesser size, while the cars pursue their motion by inertia and move independently to the end of their run.

To summarize, the operating cycle of the system beginning from a resting position is as follows:

With the car launching trolley 7 in an upper position and the counterweights 16 and 11 in a lower position, the winch moving the pulley 18 to lift the secondary counterweight 16 is started.

When the latter is fully lifted, the quick-acting hook at the opposite end of the rope 17 comes to hook up the counterweight 11.

The winch then inverts the motion of the pulley 18 and lifts the counterweight 11, while being aided in this action by the pull exerted by the counterweight 16.

The launching trolley 7 then starts its descent to move to its lower dead point, ready to hook up to the train of cars to be launched.

This situation is illustrated in FIG. 2.

The launching phase can now be initiated.

The train of cars 2 positions itself on the first rail section, where the last car is hooked up by the devices provided on the trolley 4, which is simultaneously moved forward by actuating the rope 6.

Figure 3:
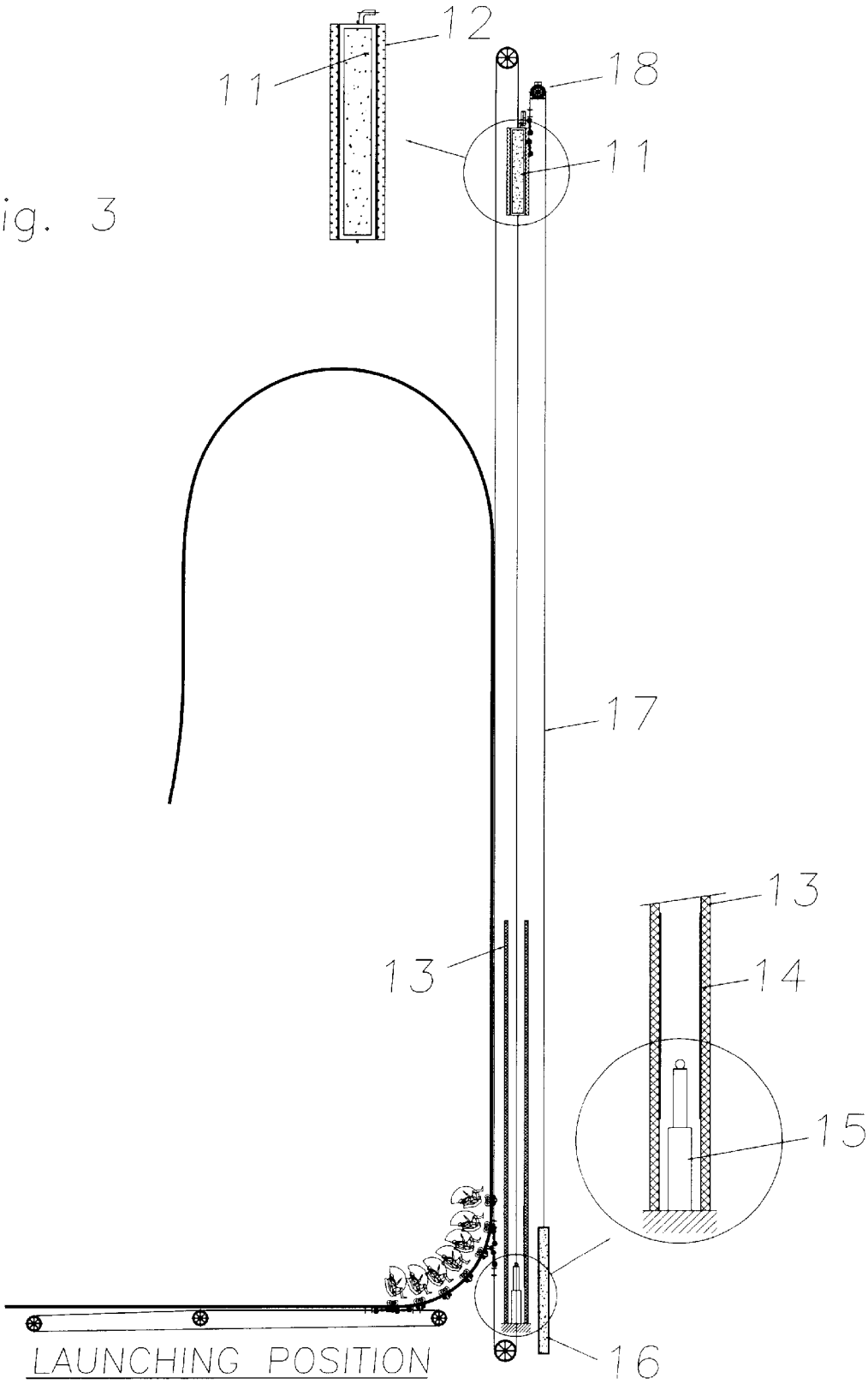
Figure 4:
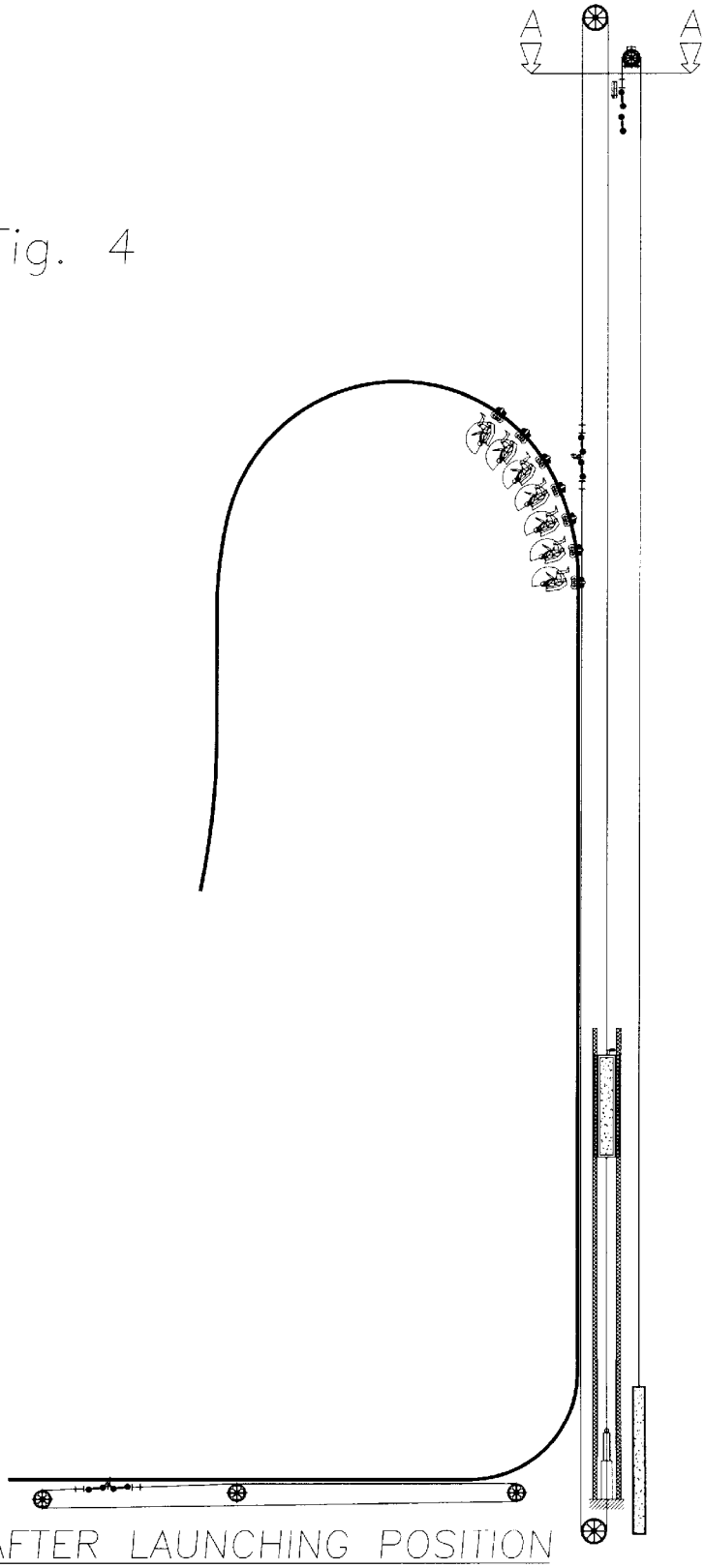

The train of cars then moves into the position of FIG. 3. Where the first cars are essentially arranged in a vertical sense.

The launching trolley starts at a slow pace, until it hooks up with one of the forward cars of the train.

Immediately after hooking up between the launching trolley 7 and the cars, the counterweight 11 is released simply by opening the quick-acting hook al the end of the rope 17 of the secondary counterweight.

The opening of this quick-acting hook is caused by the action of an electric actuator of a known type or any other similar system.

The counterweight 11 then starts its descending phase under strong acceleration, thus lifting the cars which enter the track (section C), while the counterweight, continuing its run, enters the braking devices 13, thereby reducing its speed (and consequently also that of the launching trolley 7), so as to allow the cars to be unhooked and pursue their run.

The system described above entails a number of advantages, because: it is possible to launch the cars along with their passengers upward at a considerable speed and strong acceleration while exploiting, in order to provide the necessary power, the fact that the fall of the primary counterweight is braked without consuming any energy, thanks to the use of brakes based on permanent magnets;

In order to prepare for a new launch, the counterweight must be raised up again, but due to the availability of time while the vehicles complete their rounds, it is possible to achieve this over a long period of time, and therefore from an economical viewpoint with a far lower expenditure of power.

An expert of the branch may provide a number of different versions, all of which must however be considered as falling within the scope of this invention.

What is claimed is:

1. A system for launching cars that are part of equipment used in amusement parks, in which the cars lay on a track that has a substantially vertical segment and the cars are given a speed needed to complete a run by inertia, comprising;

means for guiding the cars from a starting position toward the substantially vertical segment of the track;

means for pushing the cars onto the substantially vertical track segment which is separate and discontinuous from the guiding means;

a counterweight shifting away from an initial position and acting on the pushing means so as to give the cars an acceleration and a speed to complete a run; and means for returning the counterweight to the initial position while the cars are completing the run.

2. A system according to claim 1, wherein the guiding means comprises a moving carriage and a device for connecting the cars to the moving carriage.

3. A system according to claim 2, wherein the pushing means comprises a rope connected to a moving carriage and a device for connecting the cars to the moving carriage.

4. A system according to claim 3, wherein displacement of the counterweight moves the rope so as to haul the cars upward with acceleration and speed on the substantially vertical segment of the track and insert the cars onto a final track that follows the substantially vertical segment.

5. A system according to claim 4, wherein a means is provided for braking and slowing down the displacement of the counterweight after the cars have entered the final track so that the cars can be disconnected from the pushing means.

6. A system according to claim 5, wherein the means for braking and slowing down is braking devices with permanent magnets.

7. A system according to claim 5, wherein the permanent magnets are applied to the counterweight and interact with small metallic bars which are placed opposite a displacement path of the counterweight, the length of the metallic bars being sufficient for the permanent magnets to pass near and interact with the metallic bars.

8. A system according to claim 7, wherein an assisting weight with only a portion of the mass of the counterweight is attached to one end of a rope, a second and opposite end of the rope is attached to a connecting device for connecting the rope to the counterweight, and a winch is provided for lifting the counterweight while being aided by a force exerted by the assisting weight.

9. A system according to claim 8, wherein the winch lifts the assisting weight after the assisting weight has exerted a force to lift the counterweight.

* * * * *